US007243631B1

(12) United States Patent
Ho

(10) Patent No.: US 7,243,631 B1
(45) Date of Patent: Jul. 17, 2007

(54) PULL-START ENGINE WITH A LUBRICATING UNIT

(75) Inventor: Chao-Chang Ho, Kaohsiung Hsien (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 0 days.

(21) Appl. No.: 11/483,630

(22) Filed: Jul. 11, 2006

(30) Foreign Application Priority Data

Jun. 21, 2006 (TW) ..... 95122333 A

(51) Int. Cl.
*F02N 3/02* (2006.01)

(52) U.S. Cl. ..... 123/185.3; 123/185.2; 123/196 R; 123/196 CP

(58) Field of Classification Search ..... 123/185.3, 123/185.2, 196 R, 196 CP; 185/39, 40 R, 185/41 A See application file for complete search history.

(56) References Cited

U.S. PATENT DOCUMENTS 2,386,703 A * 10/1945 McElmurray ..... 123/185.3
3,044,239 A * 7/1962 Harkness ..... 56/12.8
6,394,061 B2 * 5/2002 Ryu et al. ..... 123/196 R
6,786,187 B2 * 9/2004 Nagai et al. ..... 123/196 R
2002/0023613 A1 * 2/2002 Ito et al. ..... 123/196 R

* cited by examiner

*Primary Examiner*—Stephen K. Cronin
*Assistant Examiner*—Ka Chun Leung
(74) *Attorney, Agent, or Firm*—Pillsbury Winthrop Shaw Pittman, LLP

(57) ABSTRACT

A pull-start engine includes a crankcase unit, a pull-start unit, a gearbox unit, and a lubricating unit. The crankcase unit includes a crankcase and a crankshaft. The gearbox unit includes a gearbox and a drive shaft. The pull-start unit is sleeved fixedly on the crankshaft. A surrounding wall of the pull-start unit has an inner wall surface formed with an annular inner slot communicated with a lubricant passage in the crankshaft, an outer wall surface formed with a through hole communicated with the inner slot, and two annular flanges flanking the through hole so as to define an annular outer slot therebetween. The lubricating unit includes an entrance passage formed in the crankcase and communicated with the outer slot, and a connecting passage formed in the crankcase and the gearbox and communicated with the outer slot and a lubricant passage in the drive shaft.

7 Claims, 4 Drawing Sheets

PULL-START ENGINE WITH A LUBRICATING UNIT

CROSS-REFERENCE TO RELATED APPLICATION

This application claims priority of Taiwanese Application No. 095122333, filed on Jun. 21, 2006.

BACKGROUND OF THE INVENTION

1. Field of the Invention

This invention relates to a pull-start engine, and more particularly to a pull-start engine that includes a lubricating unit.

2. Description of the Related Art

Referring to FIG. 1, a conventional pull-start engine includes a crankcase unit 11, a pull-start unit 12, a gearbox unit 13, a first conduit unit 14, a second conduit unit 14', and a starter motor 15. Normally, the engine is started by means of the starter motor 15. When a battery unit (not shown) for providing electricity to the starter motor 15 is fully discharged, or when the starter motor 15 malfunctions, the pull-start unit 12 can be used to start the engine.

The crankcase unit 11 includes a crankcase 111, and a crankshaft 112 journalled within the crankcase 111 and formed with a lubricant passage 113 that permits a lubricant to flow therein for lubricating and dissipating heat from the crankshaft 112.

The pull-start unit 12 is disposed rotatably on the crankcase 111, and is operable to rotate the crankshaft 112 to thereby start the engine. A surrounding wall 121 of the pull-start unit 12 is sleeved fixedly on an end of the crankshaft 112 of the crankcase unit 11.

The gearbox unit 13 includes a gearbox 131 connected fixedly to the crankcase 111 of the crankcase unit 11, and a drive shaft 132 journalled within the gearbox 131. The drive shaft 132 is formed with a lubricant passage 133 that is communicated with the second conduit unit 14' and that permits the lubricant to flow therein for lubricating and dissipating heat from the drive shaft 132.

The first conduit unit 14 is disposed in the crankcase unit 11. The lubricant is fed into one end portion of the lubricant passage 113 in the crankshaft 112 via the first conduit unit 14, and then flows from the other end portion of the lubricant passage 113 in the crankshaft 112 into the lubricant passage 133 in the drive shaft 132 via the second conduit unit 14'.

As a result, a significant amount of time is necessary for the lubricant to reach the lubricant passage 133 in the drive shaft 132. Furthermore, since heat is transferred from the crankshaft 112 to the lubricant during flow of the lubricant in the lubricant passage 113 in the crankshaft 112, when the lubricant reaches the lubricant passage 133 in the drive shaft 132, the temperature of the lubricant is high, thereby reducing the heat dissipating effect.

SUMMARY OF THE INVENTION

The object of this invention is to provide a pull-start engine that includes a lubricating unit, which can lubricate a crankshaft and a drive shaft effectively and efficiently, and which prevents excessive heating of a lubricant prior to reaching the drive shaft.

According to this invention, a pull-start engine includes a crankcase unit, a pull-start unit, a gearbox unit, and a lubricating unit. The crankcase unit includes a crankcase, and a crankshaft journalled within the crankcase and formed with a lubricant passage. The pull-start unit includes an annular base wall spaced apart from the crankcase and having an inner periphery, and a surrounding wall extending axially from the inner periphery of the base wall and sleeved fixedly on an end of the crankshaft of the crankcase unit. The surrounding wall has an inner wall surface, an outer wall surface, an annular inner slot formed in the inner wall surface, a through hole formed in the outer wall surface and communicated with the inner slot, and two annular flanges extending radially and outwardly from the outer wall surface and flanking the through hole so as to define an annular outer slot between the flanges. The gearbox unit includes a gearbox connected fixedly to the crankcase, and a drive shaft journalled within the gearbox and having a lubricant passage. The lubricating unit includes an entrance passage formed in the crankcase and communicated with the outer slot in the pull-start unit, and a connecting passage formed in the crankcase and the gearbox and communicated with the outer slot in the pull-start unit and the lubricant passage in the drive shaft.

As such, the lubricant flows from the entrance passage into the outer slot in the pull-start unit. Subsequently, a part of the lubricant flows from the outer slot into the lubricant passage in the crankshaft via the through hole and the inner slot in the pull-start unit, and another part of the lubricant flows from the outer slot into the lubricant passage in the drive shaft via the connecting passage. This results in an effective and efficient lubricating process, as well as preventing of excessive heating of the lubricant prior to reaching the drive shaft.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
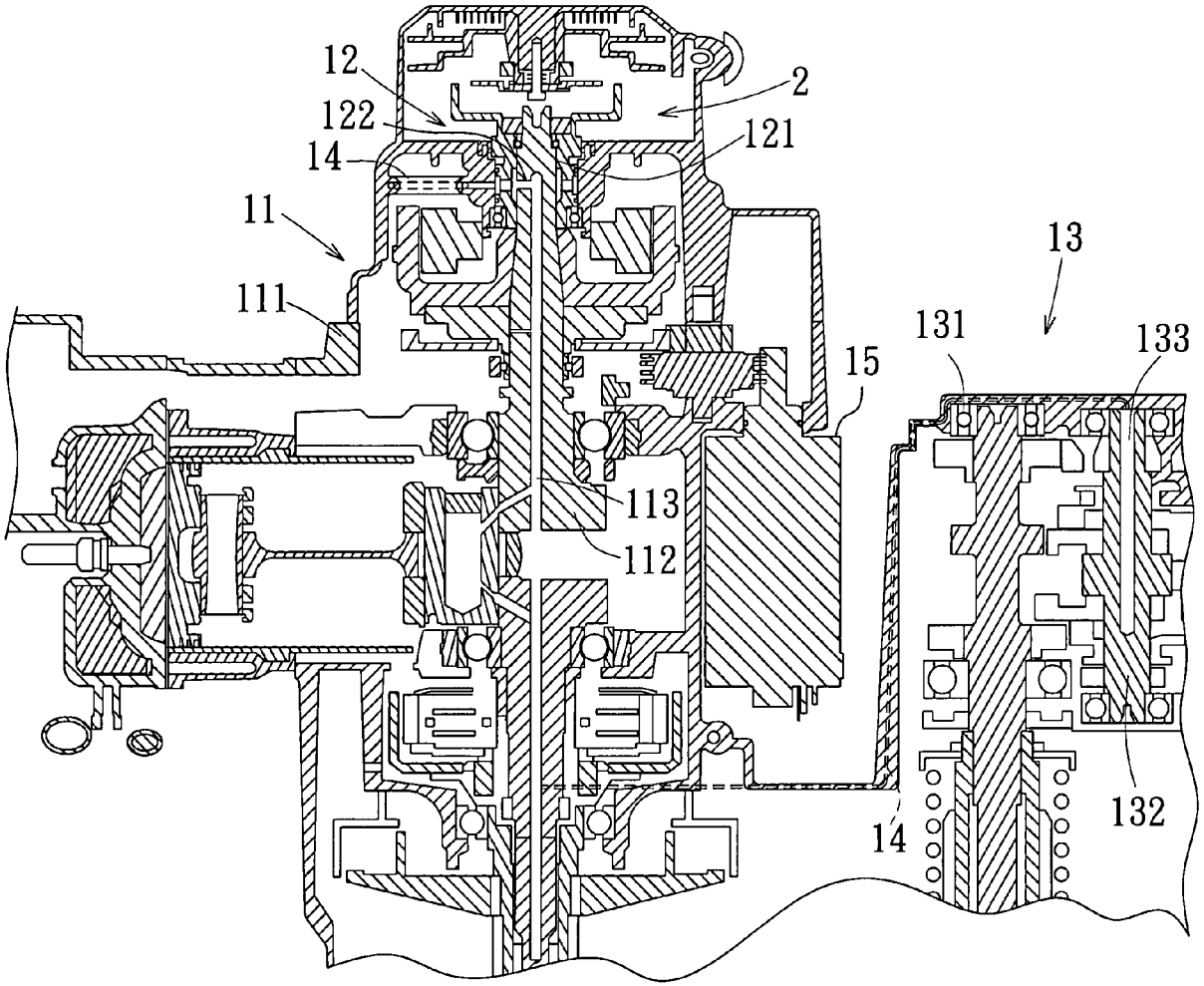
FIG. 1 PRIOR ART
FIG. 1 is a fragmentary sectional view of a conventional pull-start engine.
Figure 2:
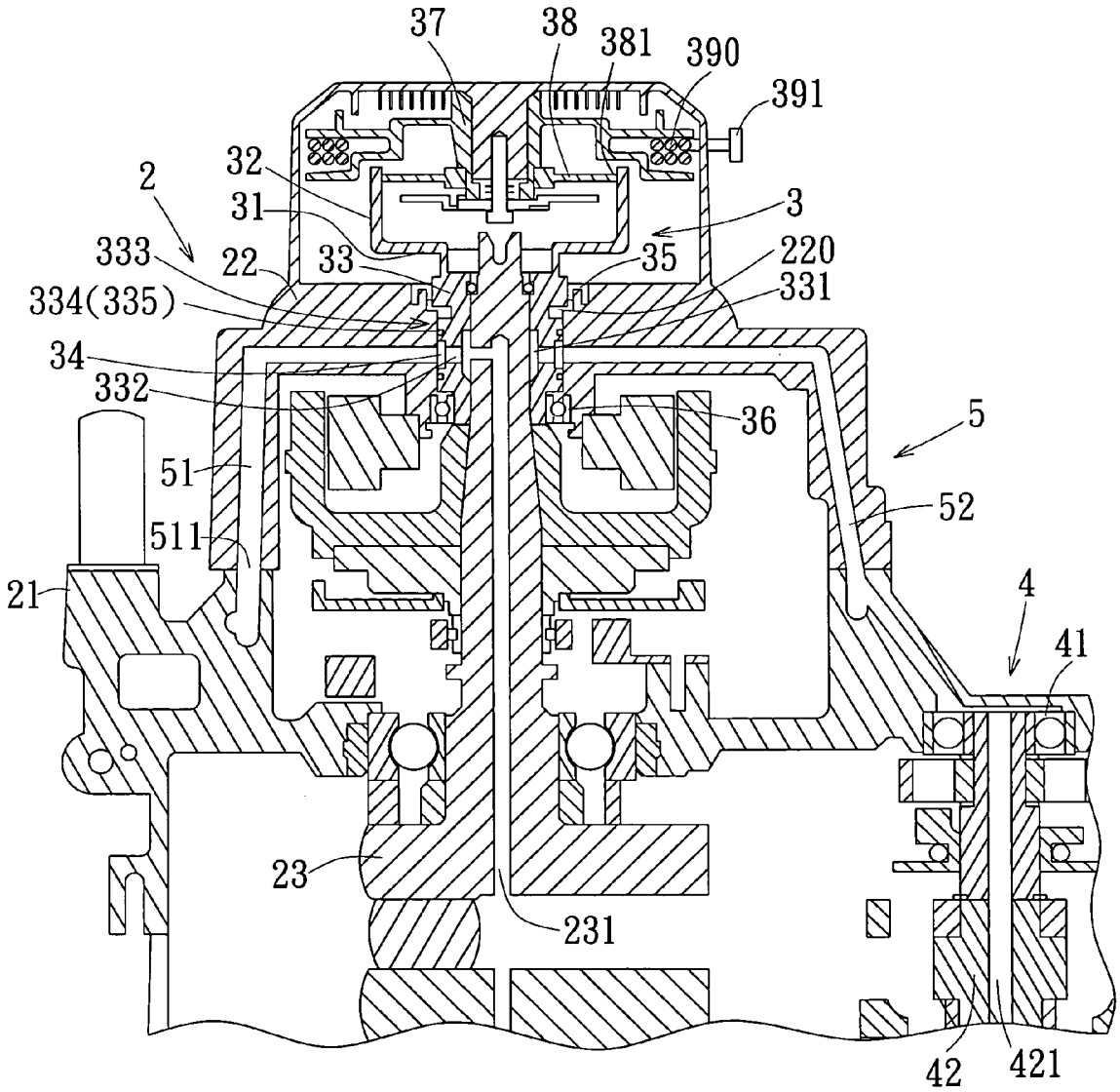
FIG. 2 is a fragmentary sectional view of the preferred embodiment of a pull-start engine according to this invention.
Figure 3:
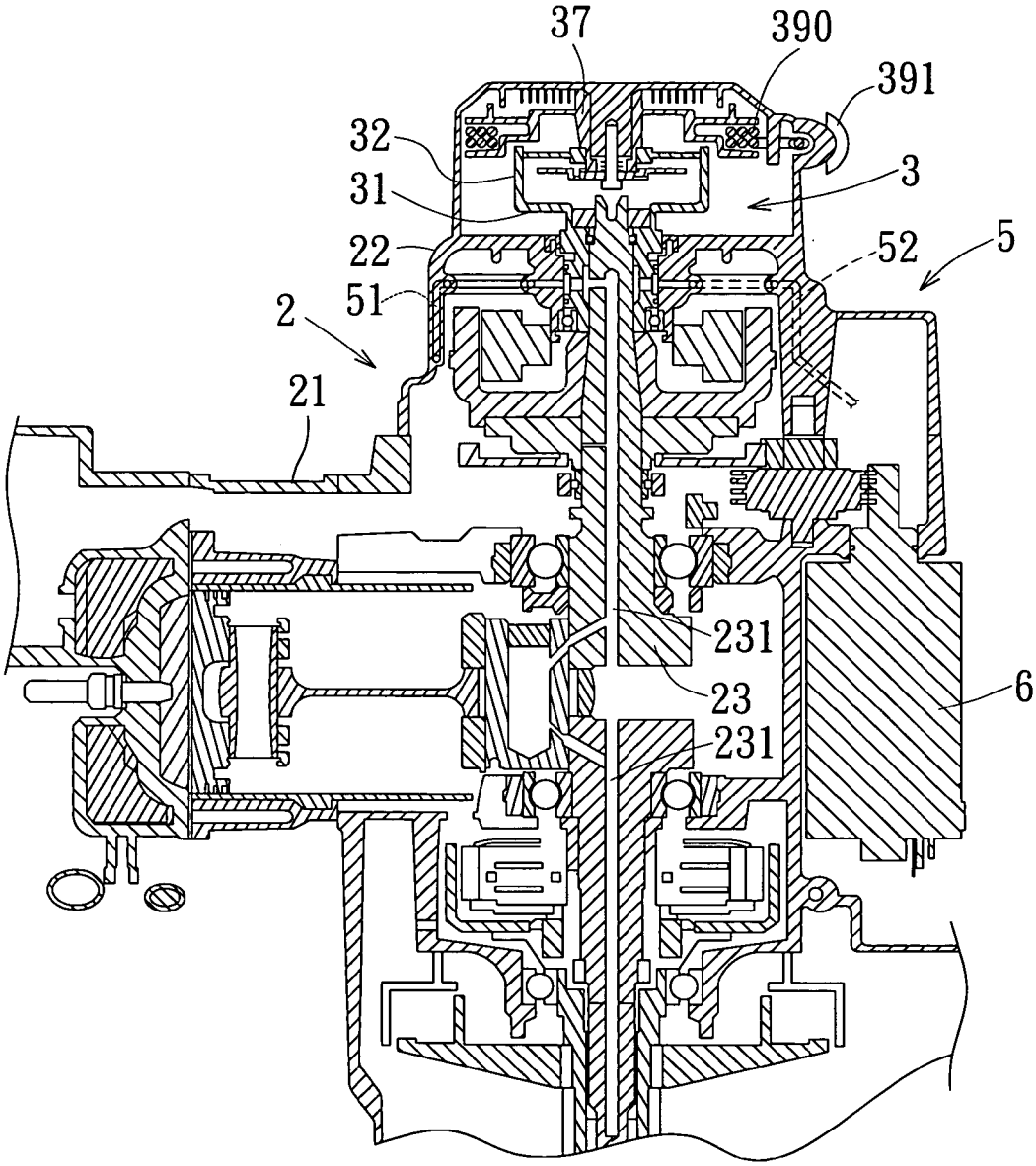
FIG. 3 is a fragmentary sectional view of the preferred embodiment, illustrating a starter motor.
Figure 4:
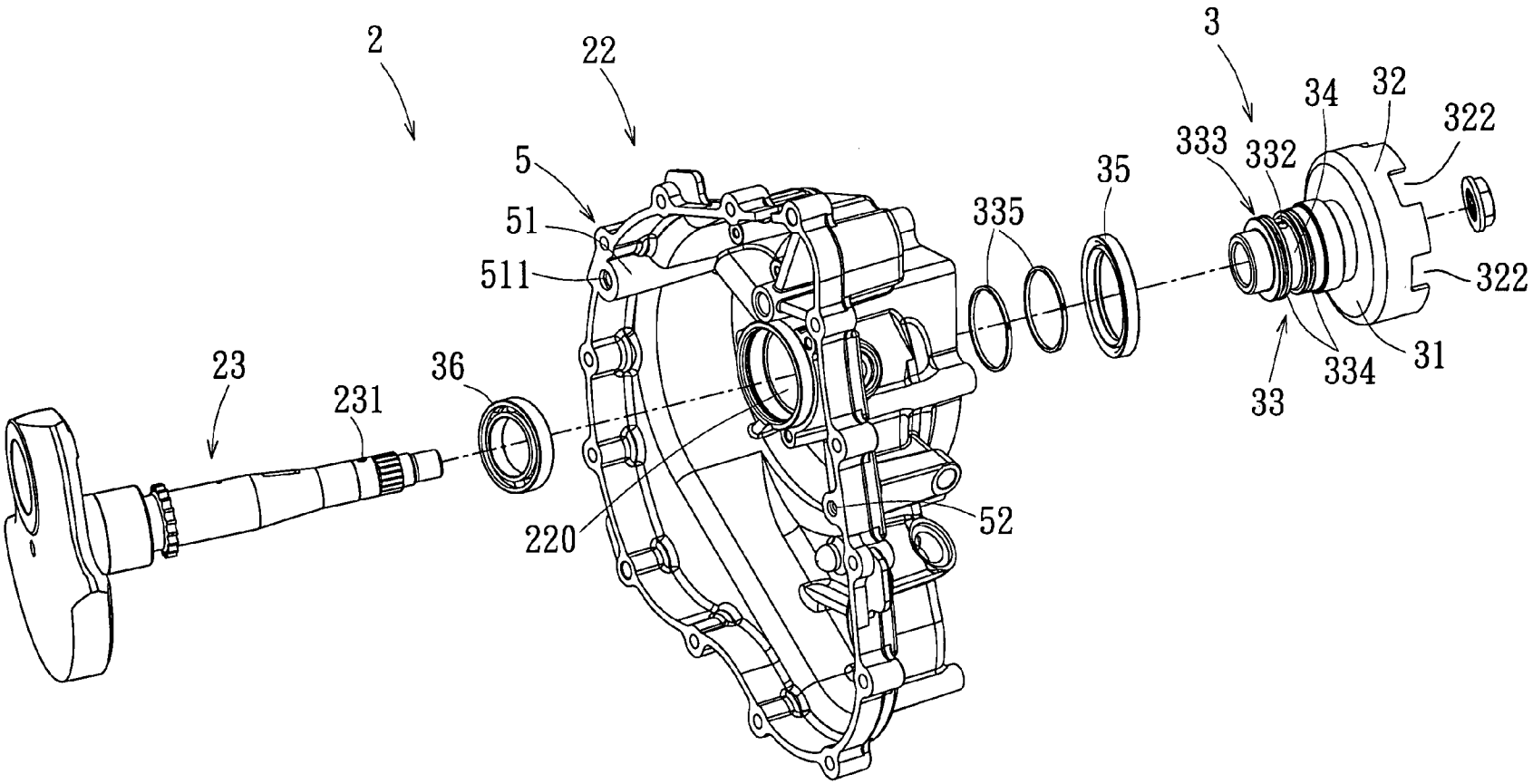
FIG. 4 is a fragmentary exploded perspective view of the preferred embodiment, illustrating a pull-start unit.

Referring to FIGS. 2 to 4, the preferred embodiment of a pull-start engine according to this invention includes a crankcase unit 2, a pull-start unit 3 serving as a standby starter device, a gearbox unit 4, a lubricating unit 5, and a starter motor 6.

The crankcase unit 2 includes a crankcase body 21, a crankcase cover 22 formed with an axial hole 220, and a crankshaft 23 journalled within the crankcase body 21. The crankcase cover 22 is connected fixedly to the crankcase body 21 so as to constitute a crankcase. The crankshaft 23 is formed with a lubricant passage 231 that permits a lubricant to flow therein for lubricating and dissipating heat from the crankshaft 23.

The starter motor 6 is disposed on the crankcase unit 2 in a known manner, and is used to start the engine. When a battery unit for providing electricity to the starter motor 6 is fully discharged, or when the starter motor 6 malfunctions, the pull-start unit 3 can be used to start the engine.

The pull-start unit 3 includes an annular base wall 31, a retaining wall 32, a surrounding wall 33, a reel 37, two retaining members 38, a pull rope 390, and a pull handle 391. The base wall 31 is spaced apart from the crankcase 22. The retaining wall 32 and the surrounding wall 33 extend respectively, integrally, and axially from outer and inner peripheries of the base wall 31 in opposite directions. The retaining member 32 is formed with a plurality of notches 322 at an end distal from the base wall 31. The surrounding wall 33 is sleeved fixedly on an end of the crankshaft 23. The reel 37 is disposed rotatably within the crankcase cover 22, and is spaced apart from the base wall 31. The retaining members 38 are disposed pivotally on the reel 37, and have free ends that are biased by a spring unit (not shown) toward a normal position whereat the free ends of the retaining members 38 are spaced apart from the retaining wall 32. The pull rope 390 is biased by the spring unit to be wound on the reel 37, and has two ends fastened respectively to the reel 37 and the pull handle 391. When use of the pull-start unit 3 is desired, the pull handle 391 is operated so as to unwind the rope 390 from the reel 37 against the biasing action of the spring unit. Hence, the free ends of the retaining members 38 pivot to engage respectively two of the notches 322 in the retaining wall 32 by virtue of centrifugal force acting on the retaining members 38. This results in co-rotation of the reel 37 with the retaining wall 32 and, thus, the crankshaft 23. Therefore, the engine is started.

The surrounding wall 33 has an annular inner slot 331 formed in an inner wall surface thereof, a radial through hole 332 formed in an outer wall surface thereof and communicated with the inner slot 331, and two annular flanges 333. The annular flanges 333 extend radially and outwardly from the outer wall surface, and flank the through hole 332 so as to define an annular outer slot 34 therebetween. Each of the flanges 333 has an annular outer surface formed with an annular slot 334 for receiving a small seal ring 335. As such, a liquid-tight seal is established between the crankcase body 21 and the flanges 333. A large seal ring 35 is disposed between the surrounding wall 33 and the crankcase body 21 and between the base wall 31 and the small seal rings 335 so as to provide a double seal between the surrounding wall 33 and the crankcase body 21. A bearing 36 is disposed between the crankshaft 23 and the crankcase cover 22 so as to facilitate rotation of the crankshaft 23 within the crankcase.

The gearbox unit 4 includes a gearbox 41 connected fixedly to the crankcase body 21, and a drive shaft 42 journalled within the gearbox 41 and formed with a lubricant passage 421 that permits the lubricant to flow therein for lubricating and dissipating heat from the drive shaft 42.

The lubricating unit 5 includes an entrance passage 51 formed in the crankcase cover 22 and having an inlet 511, and a connecting passage 52 formed in the crankcase body 21, the crankcase cover 22, and the gearbox 41. The entrance passage 51 is communicated with the outer slot 34 in the pull-start unit 3. The connecting passage 52 has two ends communicated respectively with the outer slot 34 and the lubricant passage 421 in the drive shaft 42.

When the engine is started, the lubricant is fed into the inlet 511 by a pump (not shown). The lubricant flows into the outer slot 34 via the entrance passage 51. Subsequently, a part of the lubricant flows from the outer slot 34 into the lubricant passage 231 in the crankshaft 23 via the through hole 332 and the inner slot 331 in the pull-start unit 3, and another part of the lubricant flows from the outer slot 34 into the lubricant passage 421 in the drive shaft 42 via the connecting passage 52. This results in an effective and efficient lubricating process. Furthermore, sine the lubricant reaching the drive shaft 42 does not first pass through the crankshaft 23, its temperature is kept relatively low.

With this invention thus explained, it is apparent that numerous modifications and variations can be made without departing from the scope and spirit of this invention. It is therefore intended that this invention be limited only as indicated by the appended claims.

I claim:

1. A pull-start engine comprising:

a crankcase unit including a crankcase, and a crankshaft journalled within said crankcase, said crankshaft being formed with a lubricant passage;

a pull-start unit including an annular base wall spaced apart from said crankcase and having an inner periphery, and a surrounding wall extending axially from said inner periphery of said base wall and sleeved fixedly on an end of said crankshaft, said surrounding wall having an inner wall surface, an outer wall surface, an annular inner slot formed in said inner wall surface, a through hole formed in said outer wall surface and communicated with said inner slot, and two annular flanges extending radially and outwardly from said outer wall surface and flanking said through hole so as to define an annular outer slot between said flanges;

a gearbox unit including a gearbox connected fixedly to said crankcase, and a drive shaft journalled within the gearbox and having a lubricant passage; and a lubricating unit including an entrance passage formed in said crankcase and communicated with said outer slot in said pull-start unit, and a connecting passage formed in said crankcase and said gearbox and communicated with said outer slot in said pull-start unit and said lubricant passage in said drive shaft.

2. The pull-start engine as claimed in claim 1, wherein said crankcase includes a crankcase body and a crankcase cover connected fixedly to said crankcase body and formed with an axial hole, within which said surrounding wall of said pull-start unit is disposed rotatably.

3. The pull-start engine as claimed in claim 2, further comprising two small seal rings, each of which is disposed between said crankcase body and a corresponding one of said flanges of said pull-start unit so as to establish a liquid-tight seal therebetween.

4. The pull-start engine as claimed in claim 3, further comprising a large seal ring disposed between said surrounding wall of said pull-start unit and said crankcase body and between said base wall of said pull-start unit and said small seal rings so as to provide a double seal between said surrounding wall and said crankcase body.

5. The pull-start engine as claimed in claim 2, wherein said entrance passage of said lubricating unit is formed in said crankcase cover.

6. The pull-start engine as claimed in claim 2, wherein said connecting passage of said lubricating unit is formed in said crankcase body, said crankcase cover, and said gearbox.

7. The pull-start engine as claimed in claim 2, further comprising a bearing disposed between said crankshaft and said crankcase cover so as to facilitate rotation of said crankshaft within said crankcase.

* * * * *